US006203241B1

(12) United States Patent
Gertz

(10) Patent No.: US 6,203,241 B1
(45) **Date of Patent: *Mar. 20, 2001**

(54) INERTIAL BARRIER MODULE

(76) Inventor: David C. Gertz, 240 Avenida Vista Montana, Apt. 12H, San Clemente, CA (US) 92672

( * ) Notice: Subject to any disclaimer, the term of this patent is extended or adjusted under 35 U.S.C. 154(b) by 0 days.

This patent is subject to a terminal disclaimer.

(21) Appl. No.: 09/282,699

(22) Filed: Mar. 31, 1999

Related U.S. Application Data

(63) Continuation of application No. 08/989,545, filed on Dec. 12, 1997, now Pat. No. 5,927,896.
(60) Provisional application No. 60/034,238, filed on Dec. 13, 1996.

(51) Int. Cl.[7] ..... E01F 13/00; E01F 15/00
(52) U.S. Cl. ..... 404/6; 404/9; 256/13.1
(58) Field of Search ..... 404/6, 9; 256/13.1; 116/63 P

(56) References Cited

U.S. PATENT DOCUMENTS

| | | | | |
|---|---|---|---|---|
| 3,606,258 | | 9/1971 | Fitch . | |
| 3,674,115 | | 7/1972 | Young et al. . | |
| 3,856,268 | | 12/1974 | Fitch . | |
| 3,916,816 | * | 11/1975 | Fitch | 116/63 P |
| 4,071,599 | | 1/1978 | Walker . | |
| 4,072,334 | | 2/1978 | Seegmiller et al. . | |
| 4,073,482 | * | 2/1978 | Seegmiller et al. | 267/139 |
| 4,097,572 | | 6/1978 | Walker . | |
| 4,289,419 | * | 9/1981 | Young et al. | 404/6 |
| 4,452,431 | | 6/1984 | Stephens et al. . | |
| 4,557,466 | | 12/1985 | Zucker . | |
| 4,583,716 | | 4/1986 | Stephens et al. . | |
| 4,607,824 | | 8/1986 | Krage et al. . | |
| 4,635,981 | | 1/1987 | Friton . | |
| 4,666,130 | | 5/1987 | Denman et al. . | |
| 4,688,766 | | 8/1987 | Zucker . | |
| 4,711,481 | | 12/1987 | Krage et al. . | |
| 4,784,515 | | 11/1988 | Krage et al. . | |
| 4,934,661 | | 6/1990 | Denman et al. . | |
| 5,002,423 | | 3/1991 | Mileti . | |
| 5,088,874 | | 2/1992 | Quittner . | |
| 5,112,028 | | 5/1992 | Laturner . | |
| 5,192,157 | | 3/1993 | Laturner . | |
| 5,211,503 | | 5/1993 | Quittner . | |
| 5,306,106 | | 4/1994 | Mileti . | |
| 5,314,261 | | 5/1994 | Stephens . | |
| 5,425,594 | | 6/1995 | Kragae et al. . | |
| 5,927,896 | * | 7/1999 | Gertz | 404/6 |

* cited by examiner

*Primary Examiner*—Eileen D. Lillis
*Assistant Examiner*—Raymond W. Addie
(74) *Attorney, Agent, or Firm*—Stout, Uxa, Buyan & Mullins, LLP; Donald E. Stout

(57) ABSTRACT

An inertial barrier system comprised of inertial barriers formed of two modules, each of them being differently sized and being adapted to stack one upon the other. An interlocking geometry on each of the mating ends of modules assists in obtaining a secure stacking arrangement, and also assists in varying the volumetric capacity of each of the two modules. Thus, when the smaller of the two modules is the upper module, facing upwardly so that its volumetric capacity is available for filling by a particulate ballasting material, a lighter weight barrier is obtained. On the other hand, when the two modules are inverted, and the larger one is the upper module, its greater volumetric capacity ensures that, once filled by the ballasting material, a heavier barrier will result. Advantageously, each module is sized to ensure a barrier of the proper weight when it is placed in the position of the upper module and is properly filled by a worker. Because of the differing appearance of the barriers, depending upon which module is disposed as the upper module, another advantageous feature of the invention is that it is easy to determine by visual inspection of a particular barrier what should be its approximate correct weight.

19 Claims, 3 Drawing Sheets

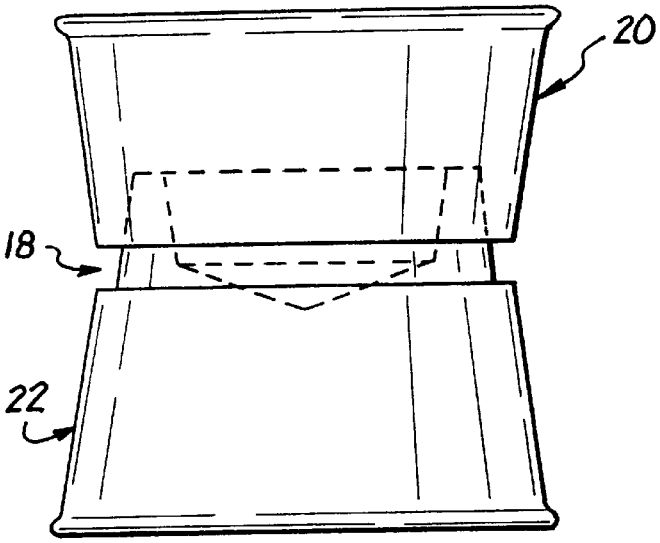
Fig. 3
Fig. 4
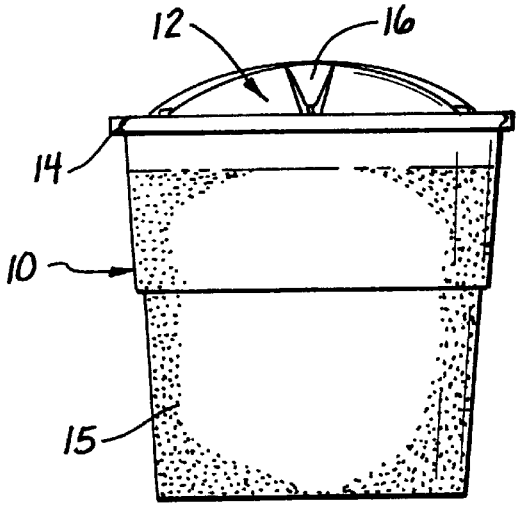
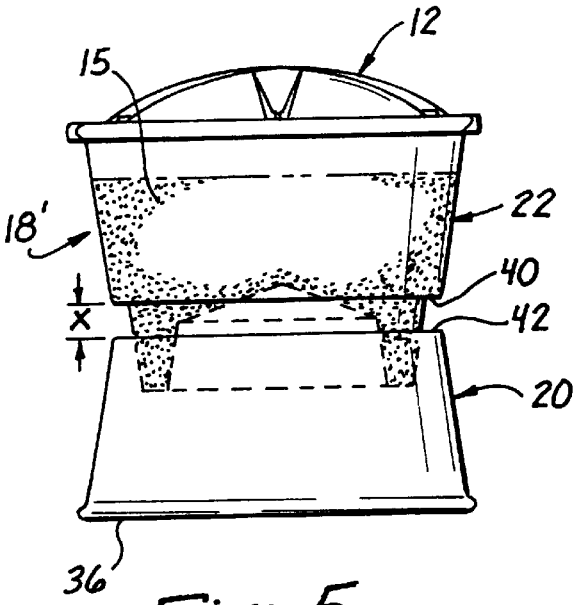
Fig. 5
Fig. 6
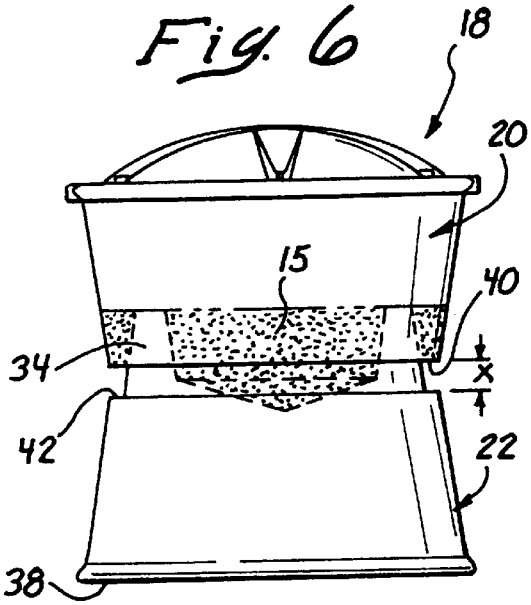

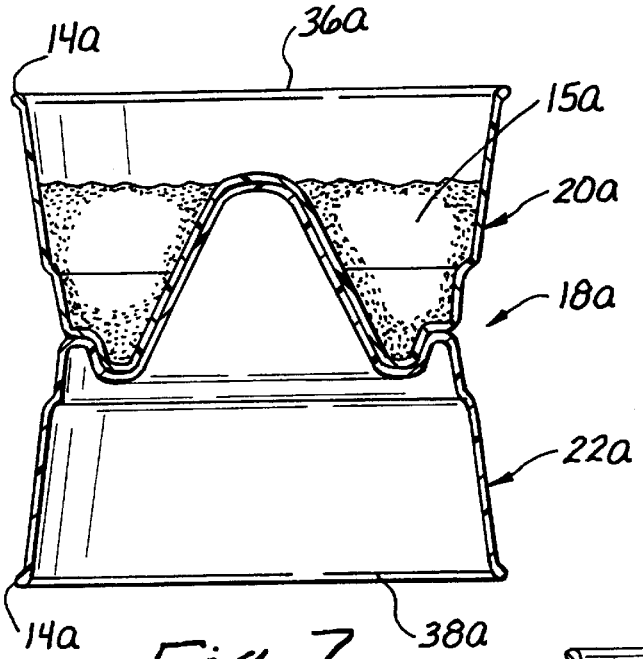
Fig. 7
Fig. 8
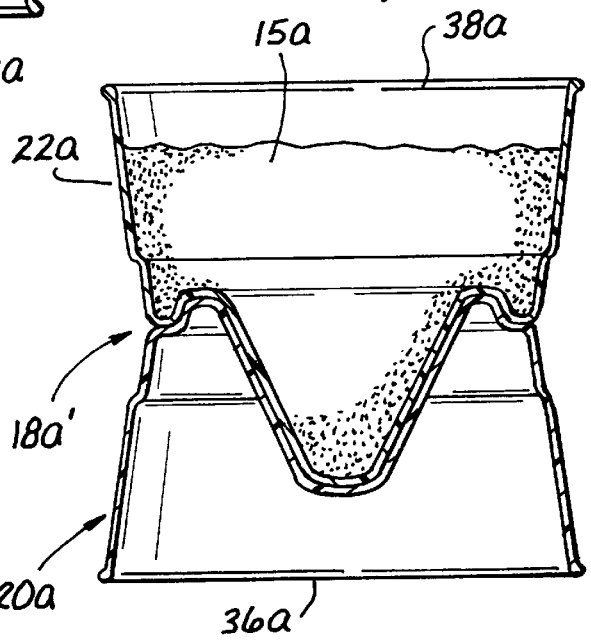
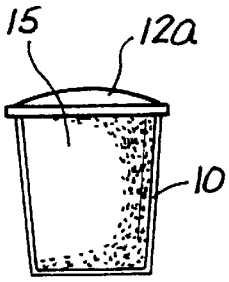
Fig. 9
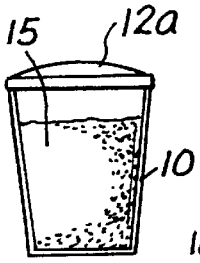
Fig. 10
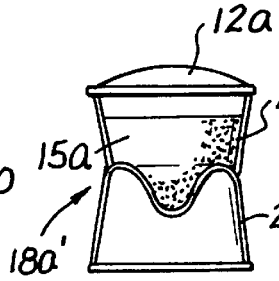
Fig. 11
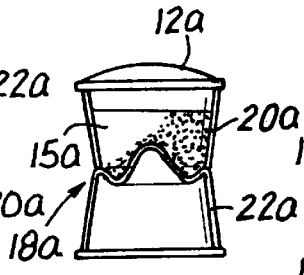
Fig. 12
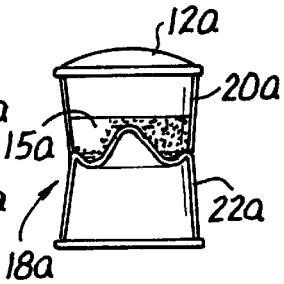
Fig. 13

INERTIAL BARRIER MODULE

This application is a continuation of U.S. patent application Ser. No. 08/989,545, filed on Dec. 12, 1997, now U.S. Pat. No. 5,927,896, which in turn claims the benefit under 35 U.S.C. 119(e) of the filing date of U.S. Provisional Patent Application Serial No. 60/034,238, filed on Dec. 13, 1996.

BACKGROUND OF THE INVENTION

This invention relates to traffic safety equipment, and more particularly to an inertial barrier system for attenuating the energy of errant vehicles.

Inertial highway barriers have been used for some time to prevent vehicles from striking an obstacle such as a bridge pier or the like at full velocity. An inertial barrier relies on the mass of the barrier to decelerate the vehicle. Typically, a dispersible material such as sand is enclosed in a frangible container. When the vehicle strikes the container, the momentum of the impacting vehicle is dissipated in accelerating the sand.

In the current state of the art, standard arrays of sand-filled energy absorbing units are employed, with the amount of sand varying from one barrier unit to the next in a predetermined fashion so that an errant vehicle crashing into the barrier system is decelerated with the minimum damage to the vehicle and its occupants. Because the plastic containers for these units are shatterable if struck at highway speeds, the effect of the barrier on stopping the errant vehicle comes about by transfer of momentum of the vehicle to the sand or other dispersible particulate medium. By arranging the barrier units, in order of striking, from lighter to heavier in terms of amount of sand contained therein, the errant vehicle can be caused to decelerate gradually and with minimum damage to the vehicle and minimum risk to its occupants.

Current standard arrays employ sand containers having weights of 200, 400, 700, 1400, and 2100 pounds. Customarily, spacers or lightweight supports are provided at the base of the barrel so that the center of gravity of the barrier unit is about the same as that of the errant vehicle, i.e. about two feet above the ground. This prevents the errant vehicle from either ramping or climbing over the units on collision or from nosing under the units. Presently, there are three primary methods for elevating the sand mass in a container. A first method, described in U.S. Pat. No. 3,606,258 to Fitch, utilizes a round Styrofoam pedestal or core at the bottom of a container. To obtain barrels having varying weights, the size of the core may be increased or reduced and/or the amount of sand used to fill the void in the barrel not occupied by the core may be varied. A second method, described in U.S. Pat. No. 4,289,419 to B. C. Young, employs an inverted U-shaped plastic support structure disposed at the bottom of the container. As shown particularly in FIG. 7 of that patent, the weight of the containers may be varied by using variously sized plastic support structures or cores to reduce or increase the interior volume of the container which is available for filling with sand.

Yet a third method, which is in primary use today, is described in U.S. Pat. No. 4,688,766 to Zucker. This method employs a plastic disc or core member 20 of a single size, which is supported on a flange disposed on the outer container. When a container having a weight of 200, 400, or 700 pounds is desired, the core is placed within the container in an upside-down configuration, as illustrated in FIGS. 2A–2C of the patent, and the proper amount of sand, according to provided markings, to achieve the desired weight, is introduced into the available reduced volume within the container. When a weight of 1400 pounds is desired, on the other hand, the orientation of the core is reversed, as illustrated in FIG. 3A of the patent, in order to increase the available volume of the container, which is filled with a greater amount of sand. Finally, when a weight of 2100 pounds is desired, as illustrated in FIG. 3B of the patent, the core is removed completely, and the container is completely filled with sand.

Each of the state-of-the art inertial barrier constructions has disadvantages. The system disclosed in the Fitch '258 patent is disadvantageous in that Styrofoam pedestals or cores of differing sizes must be used for each desired weight configuration, and varying levels of sand must be utilized as well. This is labor intensive and relatively complex, involving the maintenance of an inventory of variously sized core elements. Furthermore, the containers all have identical external configurations, regardless of their weight, making ready identification difficult. As a result, external markings, using spray paint, for example, must be utilized to externally identify the weight of a particular container.

The system disclosed in the Young patent '419 is similarly disadvantageous in that plastic support structures or cores of differing sizes must be used for each desired weight configuration, though at least the available volume in each container is filled in each instance, and there is no need to involve road crew personnel in partially filling containers to various levels. Again, the containers all have an identical appearance from the outside, making identification of the particular weight of a container difficult unless it is marked.

The Zucker patent '766 is an improvement over both Fitch and Young, in that only a single sized core is employed for each of the desired weight configurations. However, the system is still disadvantageous in that the exterior appearance of the container is identical no matter what weight configuration is being employed. Additionally, because the sand mass within the container is elevated, in all but the 2100 pound embodiment, and the bottom of the container is tapered, having a smaller diameter than the top portion, the container is hard to move, because it is unstable. Furthermore, if such a container is utilized on uneven ground, the aforementioned tapering can cause bowing of the container wall.

What is needed, therefore, is an impact attenuator configuration having as few pieces as possible, wherein when the sand mass contained therein is elevated, the exterior sidewall of the attenuator container is at least as wide at its bottom portions as it is at its upper portions. Furthermore, it would be advantageous for such a system to be configured so that containers of varying weights have distinctive external appearances, so that the weight of a particular container may be readily discerned by inspecting its external configuration.

SUMMARY OF THE INVENTION

The present invention addresses the foregoing problems by providing an inertial barrier system comprised of inertial barriers formed of two modules, each of them being differently sized and being adapted to stack one upon the other. An interlocking geometry on each of the mating ends of modules assists in obtaining a secure stacking arrangement, and also assists in varying the volumetric capacity of each of the two modules. Thus, when the smaller of the two modules is the upper module, facing upwardly so that its volumetric capacity is available for filling by a particulate ballasting material, a lighter weight barrier is obtained. On the other hand, when the two modules are inverted, and the larger one is the upper module, its greater volumetric capacity ensures that, once filled by the ballasting material, a heavier barrier will result. Advantageously, each module is sized to ensure a barrier of the proper weight when it is placed in the position of the upper module and is properly filled by a worker. Because of the differing appearance of the barriers, depending upon which module is disposed as the upper module, another advantageous feature of the invention is that it is easy to determine by visual inspection of a particular barrier what should be its approximate correct weight.

Other advantages of the invention include a system having a minimum number of individual parts, the elimination of a sand platform which can leak sand to lower portions of the barrier, and a large diameter base for the barrier in any configuration, in order to resist tipping of the barrier.

The invention, together with additional features and advantages thereof, may best be understood by reference to the following description taken in conjunction with the accompanying illustrative drawing.

BRIEF DESCRIPTION OF THE DRAWINGS

FIG. 3 is a side plan view illustrating the two-piece inertial barrier container of FIG. 2 in an assembled mode;

FIG. 4 is a cross-sectional view of the inertial barrier container illustrated in FIG. 1, assembled and filled with a particulate media such as sand;

FIG. 5 is a cross-sectional view of the embodiment illustrated in FIGS. 2 and 3, showing a first arrangement of the two-piece configuration for accommodating a particular quantity of sand;

FIG. 6 is a cross-sectional view, similar to that of FIG. 5, of the embodiment illustrated in FIGS. 2 and 3, showing a second arrangement of the two-piece configuration for accommodating a second particular quantity of sand;

FIG. 7 is a cross-sectional view of a second modified embodiment of the invention, illustrating a two-piece inertial barrier container in a first arrangement for accommodating a particular quantity of sand;

FIG. 8 is a cross-sectional view, similar to that of FIG. 7, of the second modified embodiment in a second arrangement for accommodating a second particular quantity of sand;

FIGS. 9–13 together illustrate a typical array of both one and two-piece inertial barrier containers which may be employed in front of a traffic hazard, such as a bridge abutment, in order to attenuate a crash by an errant vehicle

DESCRIPTION OF THE PREFERRED EMBODIMENT

Figure 1A:
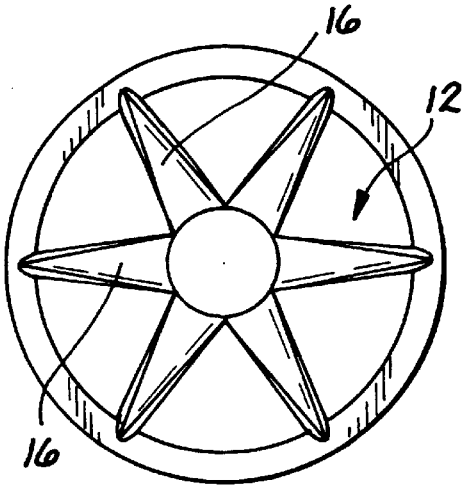
FIG. 1A is a top plan view of a lid for an inertial barrier container constructed in accordance with the principles of the present invention.
Figure 1:
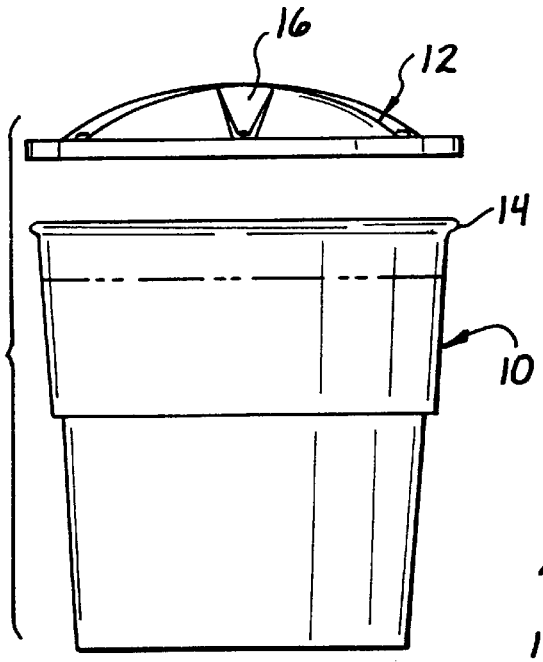
FIG. 1 is an exploded side plan view illustrating of a one-piece inertial barrier container and lid of the present invention, for use in 1400 and 2100 pound configurations.

Referring now more particularly to the drawings, FIG. 1 illustrates a one-piece inertial barrier container 10, which is fabricated of a known lightweight, frangible material, such as plastic, using a known inexpensive molding process, such as rotomolding. Such a container 10, which includes a lid 12 and a lip 14 for retaining the lid 12 in a closed position, is useful in a crash attenuation array as illustrated in FIGS. 9–13 for providing barriers of higher weight, because of its large internal volume. For example, as illustrated in FIG. 10, the container 10 may be partially filled, to a fill line molded or marked on the internal sidewall of the container, with a particulate material, such as sand 15, in order to achieve a particular barrier weight, such as 1400 pounds. Alternatively, the same container 10 may be completely filled, as illustrated in FIG. 9, in order to achieve a higher barrier weight, such as 2100 pounds.

The lid 12 is molded in a domed configuration, and includes a plurality of molded tapered recesses 16 for increasing the rigidity of the lid and for resisting crushing of the lid under heavy loading, such as in severe snow conditions.

Now with reference to FIGS. 2, 3, 5, and 6, a first preferred embodiment of a two piece inertial barrier container 18, constructed in accordance with the principles of the invention, is illustrated. In this embodiment, the container 18 comprises a first module 20 and a second module 22, which are adapted to be interlocked vertically to form the container 18. Each of the modules 20, 22 are fabricated of a known frangible material, such as plastic, and constructed using known molding techniques, such as rotomolding, such that they comprise outer cylindrical sidewalls 24, 26, respectively, which define hollow interior volumes. The second module 22 has a greater height than the first module 20, and thus a larger interior volume.

Figure 2:
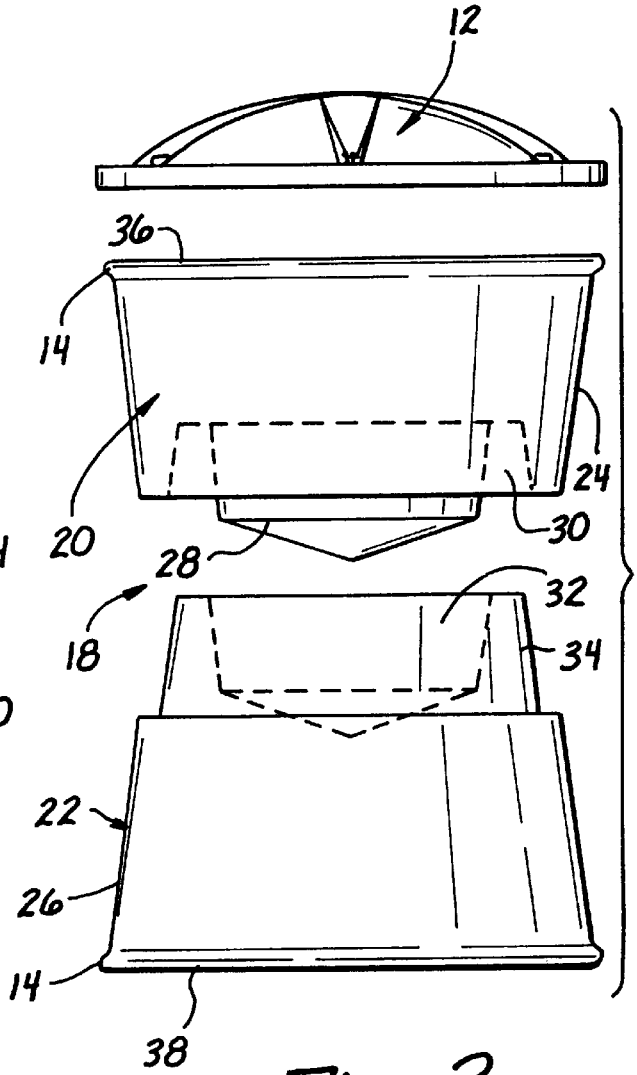
FIG. 2 is an exploded side plan view similar to that of FIG. 1, illustrating a preferred embodiment of a two-piece inertial barrier container and lid constructed in accordance with the principles of the present invention, which may be arranged to accommodate 200 pound, 400 pound, and 700 pound configurations, for example.

In the preferred embodiment of FIG. 2, the first module 20 comprises a cylindrical center projection 28 which is surrounded by an annular recess 30. The second module 22 comprises a cylindrical center recess 32, which is complementary to the cylindrical center projection 28, which is bounded by an annular projection or ridge 34 which is complementary to the annular recess 30, so that the first and second modules 20 and 22 effectively mate by joining them together such that the center projection 28 is inserted fully into the center recess 32 and the annular ridge 34 is, of course, simultaneously inserted fully into the annular recess 30, as illustrated in FIGS. 3, 5, and 6. The recesses 30 and 32 have sufficient depth that, when filly mated, and particularly when subsequently filled with sand, the resultant container, comprised of the assembled modules 20 and 22 is extremely stable and highly resistant to tipping or separation absent an impact by a vehicle.

Advantageously, both of the modules 20 and 22 have open ends 36 and 38, respectively (FIG. 2), which are wider than their mating ends, and which further each include a lip 14 for accommodating and securing a lid 12. These features result in a critical advantage of the present invention, which is the ability to invert the assembly of the two modules 20, 22 in order to fabricate a container 18 which has a varying capacity for receiving sand, so that barriers of differing weights may be achieved. For example, while FIGS. 2, 3, and 6 illustrate containers 18 wherein the module 20 is disposed atop the module 22, FIG. 5 illustrates an inverted arrangement, which might be designated as container 18', wherein the module 22 is disposed atop the module 20. Both of the arrangements of FIGS. 5 and 6 are highly stable. This stability is the result of an effective mating engagement between the two modules and also because the open ends 36 and 38 of each of the modules 20, 22, respectively are of substantially equal width with respect to one another, and both modules taper inwardly as they extend axially from their respective open ends. Thus, the open end of each module, when acting as the base of the container 18, 18', is at least as wide (radially) as any other portion of the container 18, 18' along its axial height, and significantly wider than the center portion of the axial height of the container, as illustrated in FIGS. 5 and 6.

Furthermore, because each module has a lip 14 at its respective open end, the lid 12 may be secured thereto no matter which module is uppermost, as again illustrated in FIGS. 5 and 6, so that the open end may be closed once sand has been poured thereinto.

The ability to invert the two modules results in still another advantageous feature, in that the differing capacities of each of the two modules 20, 22 permit the achievement of containers 18, 18' of differing weights simply by filling the volume of the upper module through its exposed open end. For example, when module 20, which is the smaller of the two modules, is uppermost, as illustrated in FIG. 6, particulate matter, such as sand, may be introduced into the interior chamber of the module 20 through its open end 36, but not into the interior chamber of the module 22, because it is inverted, so that its open end is not exposed. The interior chamber of the module 20 may be filled, if desired, which in the preferred embodiment will result in the barrier 18 having a weight of about 400 pounds. Alternatively, as shown in FIG. 6, a worker may fill the chamber to a level equal to the top of the annular ridge 34, which will result in the barrier having a weight of about 200 pounds. This makes it easy and convenient to produce barriers 18 having various desired weights, without the need to mark a fill line on the interior cylindrical sidewall of the module.

On the other hand, as illustrated in FIG. 5, when the larger module 22 is upright, the interior chamber thereof may be filled with sand 15 by a worker, resulting in a barrier weight of 700 pounds in the preferred embodiment. Of course, these weights may be adjusted, as desired, by adjusting the size of each of the modules 22, 20, or by varying the depth to which each interior chamber is filled.

Still another advantage of the preferred embodiment is the distinctive external appearance of the containers 18, 18' when the modules 20, 22 are joined in one of their two possible combinations. Because of the different heights of each of the modules 20, 22, a worker familiar with the system will be able, by evaluating the height of the junction between the two mated modules, to readily determine the weight of the barrier 18, 18'. For example, if the junction is relatively low, he will determine that the smaller module 20 is the base module, in which case the barrier 18' should have a weight of approximately 700 pounds. On the other hand, if the junction is relatively high, he will readily determine that the larger module 22 is the base module, in which case the barrier 18 should have a weight of approximately 400 pounds, or perhaps 200 pounds (he can determine between the two possibilities by attempting to move the barrier). This eliminates the need to mark in large unsightly numbers the weight of each barrier on the exterior sidewall thereof.

To even further enable ready visual distinction between the two different configurations of the modules 20, 22, they are preferably designed, as shown in FIGS. 5 and 6, to mate in such a manner that they are fully engaged before the mating ends 40, 42 of the modules 20, 22, respectively, are in contact with one another, leaving a gap distance x between the two mating ends 40, 42. Because of this gap x, it is easy to discern the junction line between the two modules 20, 22, and also to determine, by noting the taper direction of the annular ridge 34 visible in the gap x, the orientation of the two modules.

FIGS. 7 and 8 illustrate an alternative embodiment of the two-piece inertial barrier container 18, 18' illustrated in FIGS. 2, 3, 5, and 6, wherein like elements are designated by like reference numerals preceded by the letter a. Thus, there is shown in FIG. 7 an inertial barrier container 18*a* comprising a module 20*a* and a module 22*a*, which are mated together with the module 20*a* being uppermost and inverted, so that it can receive sand 15*a*. FIG. 8 illustrates the inverted version, wherein module 22*a* is uppermost and the two modules form container 18*a'*. Again, as in the embodiment of FIG. 2, the lower module in each container 18*a*, 18*a'* supports the upper module, which is filled with sand 15*a*, to elevate the center of gravity of the sand to approximately 24 inches above the ground. A small interlocking rim (not shown) may be disposed at the junction of the modules 20*a* and 22*a* in order to ensure that they remain interlocked during the course of ordinary movement of the container 18*a*, 18*a'* from one position to another, as by sliding, or limited tipping by workers.

An inertial barrier array for stopping errant vehicles can be constructed by employing progressively more massive containers, as illustrated in FIGS. 9–13. As illustrated, one would employ the heaviest container 10 at a location nearest the obstruction to be protected, such as a bridge abutment. Thus, the container 10 of FIG. 9 is completely filled with sand 15 so that it weighs approximately 2100 pounds. Next, the second heaviest container is employed, such as the container 10 of FIG. 10, which is identical to the container 10 of FIG. 9 but is only partially filled with sand so that it weighs about 1400 pounds. In FIG. 11 is shown the next container 18*a'* to be employed, which is about 700 pounds. FIG. 12 illustrates the next container 18*a* to be employed (about 400 pounds). Finally, the lightest container 18*a* is initially employed, having the smaller module 20*a* on top, which is only partially full of sand to weigh about 200 pounds. Thus, an errant vehicle will initially strike the lightest container 18*a*, which will shatter but begin to reduce the momentum of the vehicle while minimizing damage thereto. Then, the next lightest container 18*a*, of FIG. 12 will be impacted, further reducing the vehicle's momentum, but still minimizing damage to the vehicle because of its relatively light weight and the slower speed of the vehicle. As the vehicle continues to slow, ti will impact heavier and heavier containers in order to more quickly reduce its momentum, but damage to the vehicle will still be limited because of its slower speed and the frangible nature of the containers. Finally, container 10 of FIG. 9 will be impacted by a much slowed vehicle, which will hopefully then be fully stopped without injury to the occupants before impact with the bridge abutment or other immovable obstacle.

Of course, while the array of FIGS. 9–13 is illustrated using the containers of the second embodiment of FIGS. 7 and 8, it could obviously use the containers of the preferred embodiment of FIGS. 2, 3, 5, and 6 as well, and, in fact, at present that would be the preferred array.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An inertial barrier for protecting a vehicle from a roadway hazard, comprising:

a first module having an outer sidewall, a mating end, an interior volume defined by said outer sidewall, and an open end opposite to said mating end for providing access to said interior volume; and a second module having an outer sidewall, a mating end, an interior volume defined by said outer sidewall, and an open end opposite to said mating end for providing access to said interior volume;

said first and second modules being mateable to one another in a vertical stacking orientation to together form said inertial barrier;

wherein both of said first and second modules are interchangeably usable as an upper one of the stacked pair of modules forming said inertial barrier, and when being used as said upper module has its open end in an upward orientation, so that its interior volume is fillable with a ballasting material.

2. The inertial barrier as recited in claim 1, wherein each of said first and second modules further comprises a lip circumferentially disposed about the open end thereof, said barrier further comprising a lid for covering the exposed open end of said upper module, said lip engaging said lid to secure the lid in a closed position.

3. The inertial barrier as recited in claim 2, wherein said first module has a lesser height and a smaller interior volume than said second module.

4. The inertial barrier as recited in claim 3, wherein said first module comprises said upper module.

5. The inertial barrier as recited in claim 3, wherein said second module comprises said upper module.

6. The inertial barrier as recited in claim 1, wherein the open end of the lower module comprises the base of said barrier, said barrier having an axial height and said lower module having a width at least equal to the width of said barrier at any other location along said axial height.

7. The inertial barrier as recited in claim 6, and further comprising a junction between said stacked upper and lower modules, the barrier at said junction having a width smaller than the width at said barrier base.

8. The inertial barrier as recited in claim 1, wherein each of said modules is comprised of a frangible material.

9. The inertial barrier as recited in claim 1, wherein the mating end of said first module comprises a projecting portion and a recess portion, and the mating end of said second module comprises a projecting portion and a recess portion, such that when the two modules are stacked together, the projecting portion of the first module is inserted into the recess portion of the second module, and the projecting portion of the second module is inserted into the recess portion of the first module, the respective projecting and recess portions of each module being complementarily shaped.

10. The inertial barrier as recited in claim 9, wherein when said first and second modules are fully mated, a gap is disposed between said two modules.

11. An inertial barrier for attenuating the energy of an errant vehicle, comprising:

a lower module; and an upper module stacked atop said lower module to form a frangible barrier, so that at least a substantial portion of a total height of said upper module is disposed outside of and above an upper end of said lower module;

said upper module having an open upwardly facing end and an interior volume adapted to receive a ballasting material; and a mechanical interlock system for securing said lower module to said upper module to avoid separation of said modules in normal use of the inertial barrier, comprising two engaging portions, one portion of which is disposed on each of the upper and lower modules.

12. The inertial barrier as recited in claim 11, wherein said two engaging portions comprise a projecting portion and a recess portion, said projecting portion being disposed on one of said upper and lower modules, and said recess portion being disposed on the other of said upper and lower modules.

13. The inertial barrier as recited in claim 11, wherein said lower module has a downwardly facing open end and an interior volume.

14. The inertial barrier as recited in claim 12, wherein said upper module is covered by a lid.

15. The inertial barrier as recited in claim 14, wherein said lid is dome-shaped and has recessed areas for reinforcement.

16. The inertial barrier as recited in claim 11, wherein the mechanical interlock system comprises interlocking geometry at the joint between the upper and lower modules.

17. The inertial barrier as recited in claim 11, wherein the upper module is of a different size than the lower module, said upper and lower modules being invertible, such that the upper module becomes the lower module and the lower module becomes the upper module, in order to provide a different volumetric capacity in the upper module in an inverted position than in a non-inverted position.

18. An inertial barrier for attenuating the energy of an errant vehicle, comprising:

a lower module; and an upper module stacked atop said lower module to form a frangible barrier;

said upper and lower modules being invertible, such that the upper module becomes the lower module and the lower module becomes the upper module, in order to provide a different volumetric capacity in the upper module in the inverted position than in a non-inverted position.

19. The inertial barrier as recited in claim 18, wherein said lower and upper modules are of different sizes.

* * * * *